US007063437B2

(12) United States Patent
Taddeo et al.

(10) Patent No.: US 7,063,437 B2
(45) Date of Patent: Jun. 20, 2006

(54) ILLUMINATING DEVICE WITH SOUND DISCRIMINATOR FOR HAND-HELD CONTAINER

(76) Inventors: Robert Taddeo, 12 Cauldwell St., Eastchester, NY (US) 10709; John Antonelli, 5 Pine Cir., Eastchester, NY (US) 10709

( * ) Notice: Subject to any disclaimer, the term of this patent is extended or adjusted under 35 U.S.C. 154(b) by 94 days.

(21) Appl. No.: 10/887,900

(22) Filed: Jul. 12, 2004

(65) Prior Publication Data

US 2006/0007674 A1 Jan. 12, 2006

(51) Int. Cl.
*A45C 15/06* (2006.01)
*F21V 23/04* (2006.01)

(52) U.S. Cl. ..... 362/156; 362/276

(58) Field of Classification Search ..... 362/156, 362/154, 155; 340/815.46
See application file for complete search history.

(56) References Cited

U.S. PATENT DOCUMENTS

| | | | | |
|---|---|---|---|---|
| 3,893,081 | A * | 7/1975 | Hopkins | 340/815.46 |
| 4,417,235 | A | 11/1983 | Del Grande | |
| 4,633,234 | A | 12/1986 | Gagnon | |
| 4,912,611 | A | 3/1990 | Lyle | |
| 4,954,934 | A | 9/1990 | Kidder et al. | |
| 6,267,485 | B1 | 7/2001 | Rodgers | |
| 6,447,142 | B1 | 9/2002 | Weir | |
| 6,900,735 | B1 * | 5/2005 | Guerrieri et al. | 340/321 |

* cited by examiner

*Primary Examiner*—Alan Cariaso
(74) *Attorney, Agent, or Firm*—Christopher Wood; Wood, Ngo & Eisenberg, PLLC

(57) ABSTRACT

An illuminating device for illuminating the interior of a hand-held container. The illuminating device comprises a housing, a lighting circuit, and a sound discriminator operably connected to the lighting circuit. In one embodiment of the invention the sound discriminator is adapted to activate a light source in response to predetermined level and/or frequency of sound energy detected inside the hand-held container.

14 Claims, 7 Drawing Sheets

ILLUMINATING DEVICE WITH SOUND DISCRIMINATOR FOR HAND-HELD CONTAINER

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates to an illuminating device, and more particularly to an illuminating device for illuminating the interior of a hand-held container.

BACKGROUND OF THE INVENTION

A person standing in front of an ATM outside a bank, waiting or walking in a dark street, alleyway, or underground garage, or sitting in a vehicle or room requiring additional lighting, may want to quickly find something, such as car keys, an ATM card, lipstick, a pen or pencil, or a cell phone, in the person's hand-held container, such as a purse, hand bag, gym bag, or briefcase.

While there are numerous published references that describe various types of illuminating devices, and bags or purses having lighting systems, the applicants are unaware of a teaching or suggestion of an illuminating device for illuminating the interior of a hand-held container when a predetermined level and/or frequency of sound energy is detected inside the container. A review of the prior art follows.

U.S. Pat. No. 4,912,611 issued Mar. 27, 1990 to Lyle, describes a handbag battery powered flashlight with a separate control switch that can be rapidly moved from handbag to handbag of either the rigid frame construction or the foldable fabric type. According to the '611 patent, the control switch with actuating arms pressing against the sides of the handbag closes the switch contacts whenever the handbag is opened. The '611 patent also states that the flexible electrical conductor connecting the light source to the control switch permits moving the light source to various locations for inspecting the external compartments of the handbag as well as illuminating the keyhole in a door or automobile ignition lock.

U.S. Pat. No. 4,954,934 issued Sep. 4, 1990 to Kidder et al., describes a purse light consisting of a housing removably secured by hook and loop pile strips to interior surface of a purse so that a switch in an on position will activate a battery powered light bulb to illuminate the interior of the purse. According to the '934 patent, a modified purse light consists of an elongated dome lens that has a pair of parallel grooves running along interior of open rear end thereof. A slideable base plate fits as a tongue into the groove. A battery is carried on one end of the base plate while a light bulb is carried in middle of the base plate and is electrically connected to the battery. A toggle switch is carried on other end of the base plate and is electrically connected between the battery and the light bulb for turning the light bulb on and off. Hook and loop strips are mounted to rear surface of the dome lens and interior surface of a purse so that when the toggle switch is in an on position the light bulb will illuminate the interior surface of the purse through the dome lens.

U.S. Pat. No. 6,267,485 issued Jul. 31, 2001 to Rodgers, describes a bag which has a light controlled by a timing circuit so that the light is only turned on for a set period by an OFF to ON transition of a motion responsive switch occurring outside the set period. According to the '485 patent, a manually operated normally open switch may allow control of the light state independently of the timing circuit.

U.S. Pat. No. 6,447,142 issued Sep. 10, 2002 to Weir, describes a purse with a built in light system. According to the '142 patent, the light system is activated by a switch that turns the light on when the purse is opening and turns the light off when the purse is closed. The light is transmitted from a light source into an item holding chamber within the purse liner through a fiber optic cable.

None of the above patents, taken either singly or in combination, is seen to describe the instant invention as claimed.

SUMMARY OF THE INVENTION

An illuminating device for illuminating the interior of a hand-held container. The illuminating device comprises a housing, a lighting circuit, and a sound discriminator operably connected to the lighting circuit. In one embodiment of the invention the sound discriminator is adapted to activate a light source in response to predetermined level and/or frequency of sound energy detected inside the hand-held container.

Accordingly, it is a principal object of the invention to provide an illuminating device for illuminating the interior of a hand-held container.

Accordingly, it is further object of the invention to provide an illuminating device for illuminating the interior of a hand-held container when a predetermined level of sound energy is detected inside the hand-held container.

Accordingly, it is another object of the invention to provide an illuminating device for illuminating the interior of a hand-held container when a predetermined frequency of sound energy is detected inside the hand-held container.

Accordingly, it is still another object of the invention to provide an illuminating device for illuminating the interior of a hand-held container for a predetermined amount of time when a predetermined level or frequency of sound energy is detected inside the hand-held container.

This and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
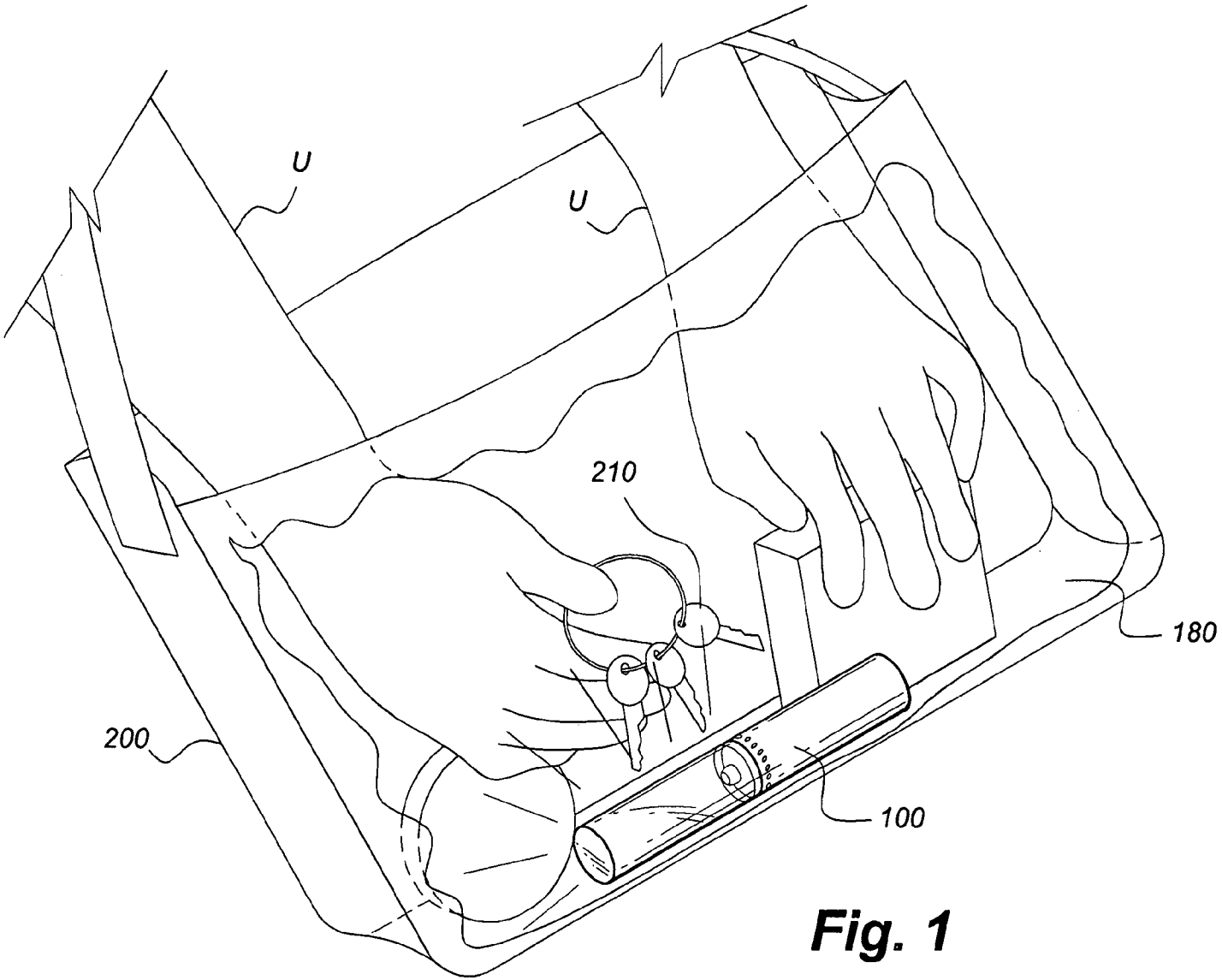
FIG. 1 is a partially cut-away perspective environmental view of an illuminating device located in a handbag or purse.

This invention is directed to an illuminating device, and particularly to an illuminating device for illuminating the interior of a hand-held container. More particularly, the invention is directed to an illuminating device that is capable of lighting the interior of a hand-held container in response to a predetermined level of sound energy or frequency of sound energy detected inside the hand-held container.

It should be understood that the term "hand held container" as used herein covers any type of hand-held container having an interior such as, but not limited to: a hand-bag, purse, and pouch.

Referring to the FIGURES in general, the illuminating device of the invention is denoted by the reference numeral 100 as a whole. The illuminating device 100 comprises a housing 120, a lighting circuit 140, and a sound discriminator 160. The sound discriminator 160 is operably connected to the lighting circuit 140; the sound discriminator 160 is adapted to detect a predetermined level and/or frequency of sound energy inside the interior 180 of a hand-held container 200. When the sound discriminator 160 detects the predetermined amount or frequency of sound energy the sound discriminator 160 activates the lighting circuit 140 to illuminate the interior 180 of hand-held container 200.

The housing 120 may adopt any suitable shape; the preferred shape such as a tubular elongated shape having opposite ends 220 and 240. At least one light source 260 is located at one or both ends 220 and 240 (see, e.g., FIGS. 2 and 3). At least one optional light cover 280 covers the at least one light source 260. The at least one optional light cover 280 can be made of any suitable transparent or translucent material such as translucent polymer for transmission of light there-through. Transparent and translucent materials are often found on energy efficient night lights available at stores such as Walgreens, e.g., the "GE NIGHT LIGHT" has a light transmissible cover for a 4 Watt light bulb; the "GE NIGHT LIGHT" is supplied by GE Home Electric Products, Inc.

FIG. 1 shows a person rummaging in a hand-container 200 in the form of a handbag. Specifically, user U is rummaging inside interior 180 of hand-container 200. Such rummaging generates noise, e.g., a set of jangling keys 210. The noise is detected by the illuminating device 100, and more particularly by the sound discriminator 160 (see, e.g., FIGS. 4 and 5A). The sound discriminator 160 is operably linked to the lighting circuit 140 (see FIG. 5A) that causes light to shine inside the interior 180 of the hand-held container 200 as shown in FIG. 1.

Figure 2:
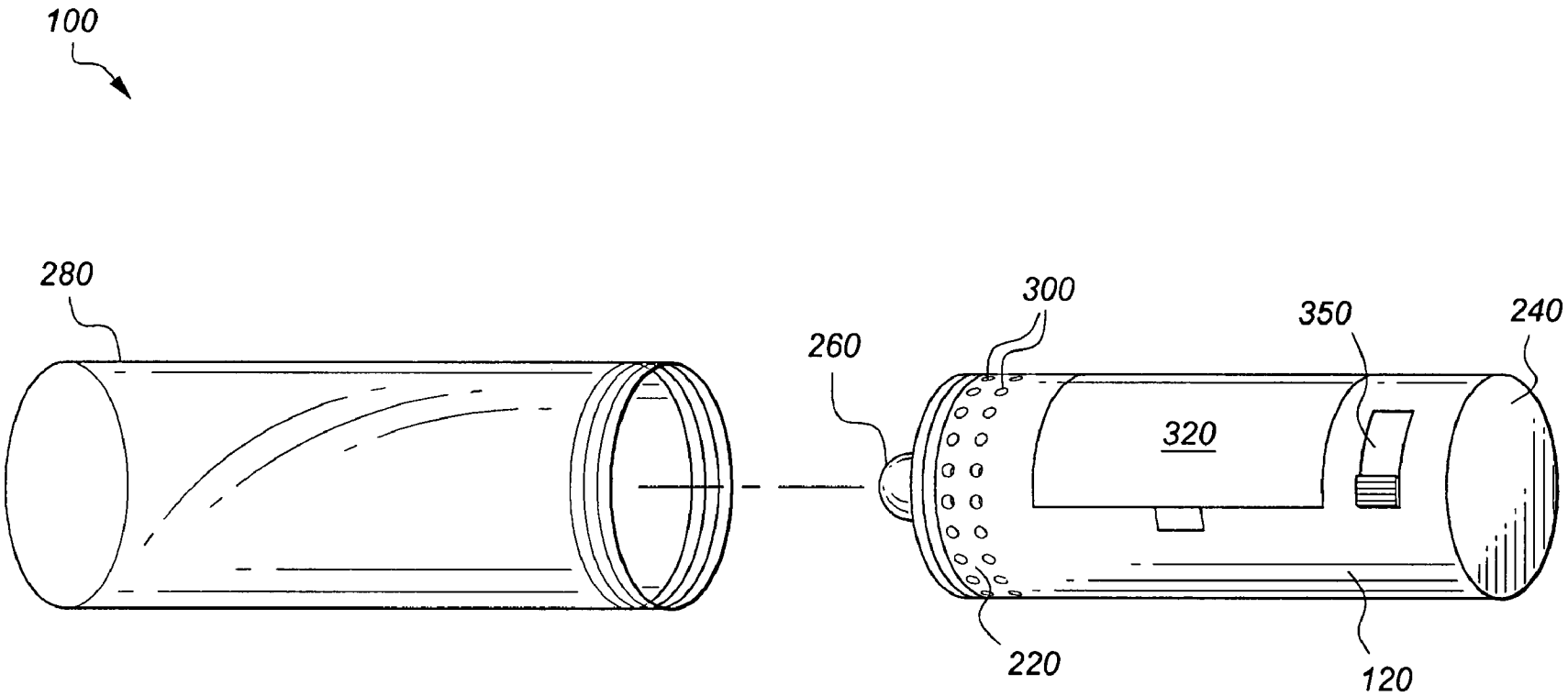
FIG. 2 shows a first embodiment of the illuminating device according to the present invention.
Figure 4:
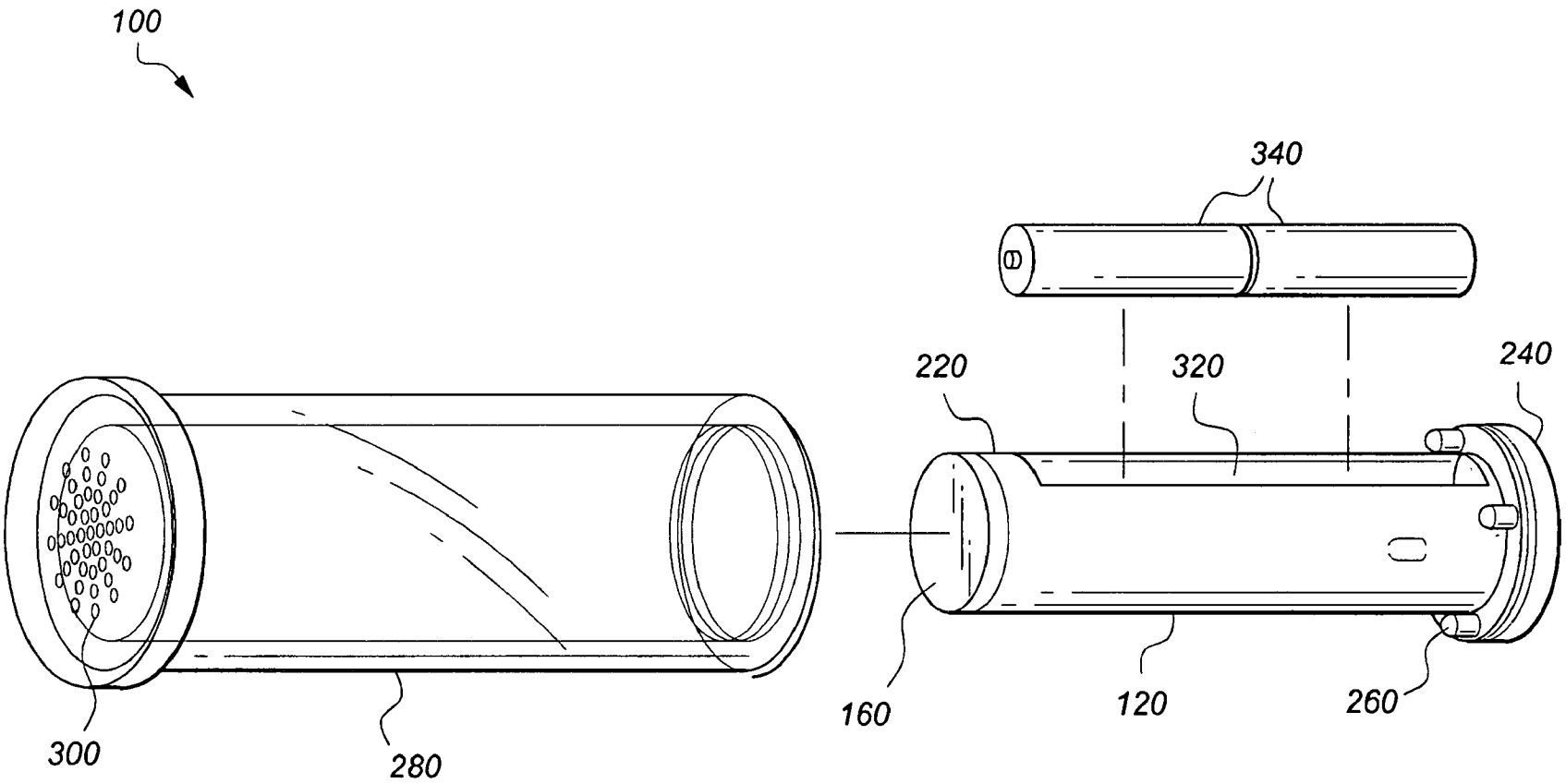
FIG. 4 shows a third embodiment of the illuminating device according to the present invention.

FIG. 2 shows a first embodiment of the invention 100. The at least one light cover 280 is configured to snap-on or screw on to end 220 of device 100. The end 220 includes a plurality of perforations 300, which allow noise to reach sound discriminator 160 (not visible in FIG. 2, but shown in FIG. 4). The lighting circuit 140 and sound discriminator 160 (also see FIG. 5A) are located inside housing 120 along with the rest of lighting circuit 140 (see FIG. 5A). The housing 120 includes a conventional battery compartment 320 for housing at least one battery 340 such as 2 AA or 2 AAA batteries as shown in FIG. 4. A manually operated on/off switch 350 is located proximate to end 240. It should be understood that the exact arrangement of the component parts of device 100 may vary without detracting from the spirit of the present invention; for example, switch 350 could be located proximate to end 220.

Figure 3:
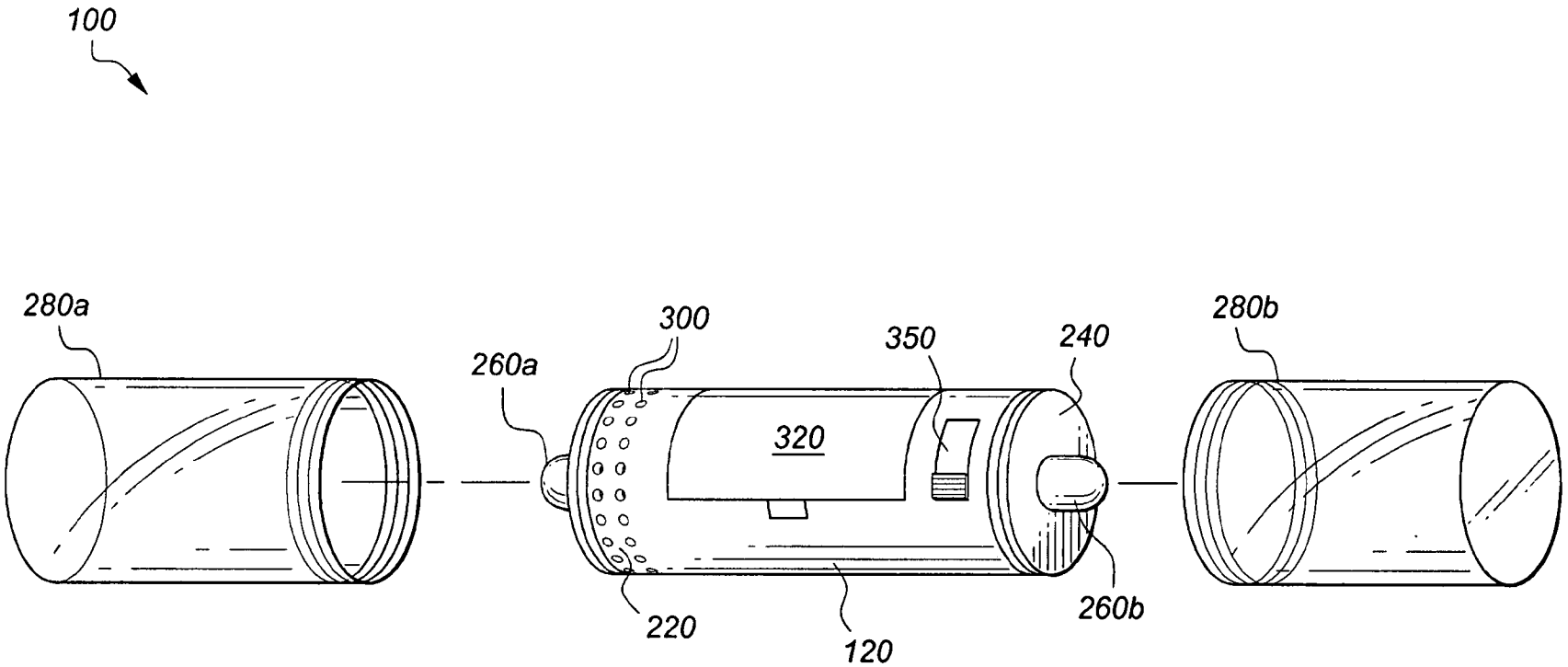
FIG. 3 shows a second embodiment of the illuminating device according to the present invention.

FIG. 3 shows a second embodiment of the invention 100. First and second lights (shown as "260*a*" and "260*b*") are located at ends 220 and 240, respectively. Two light covers 280 (represented by alpha-numeral labels "280*a*" and "280*b*") attach to ends 220 and 240, respectively. Perforations 300 and on/off switch 350 are respectively located proximate to ends 220 and 240.

FIG. 4 shows a third embodiment of the invention 100. In this embodiment the optional light cover 280 fits over the housing 120. The light source 260 is located proximate to end 240 of housing 120 and comprises at least one light emitting diode (LED) 360. The light source 260 may comprise a low power light bulb such as a 4-Watt light bulb. Two AA or AAA batteries 340 are aligned in series inside housing 120.

Figure 5A:
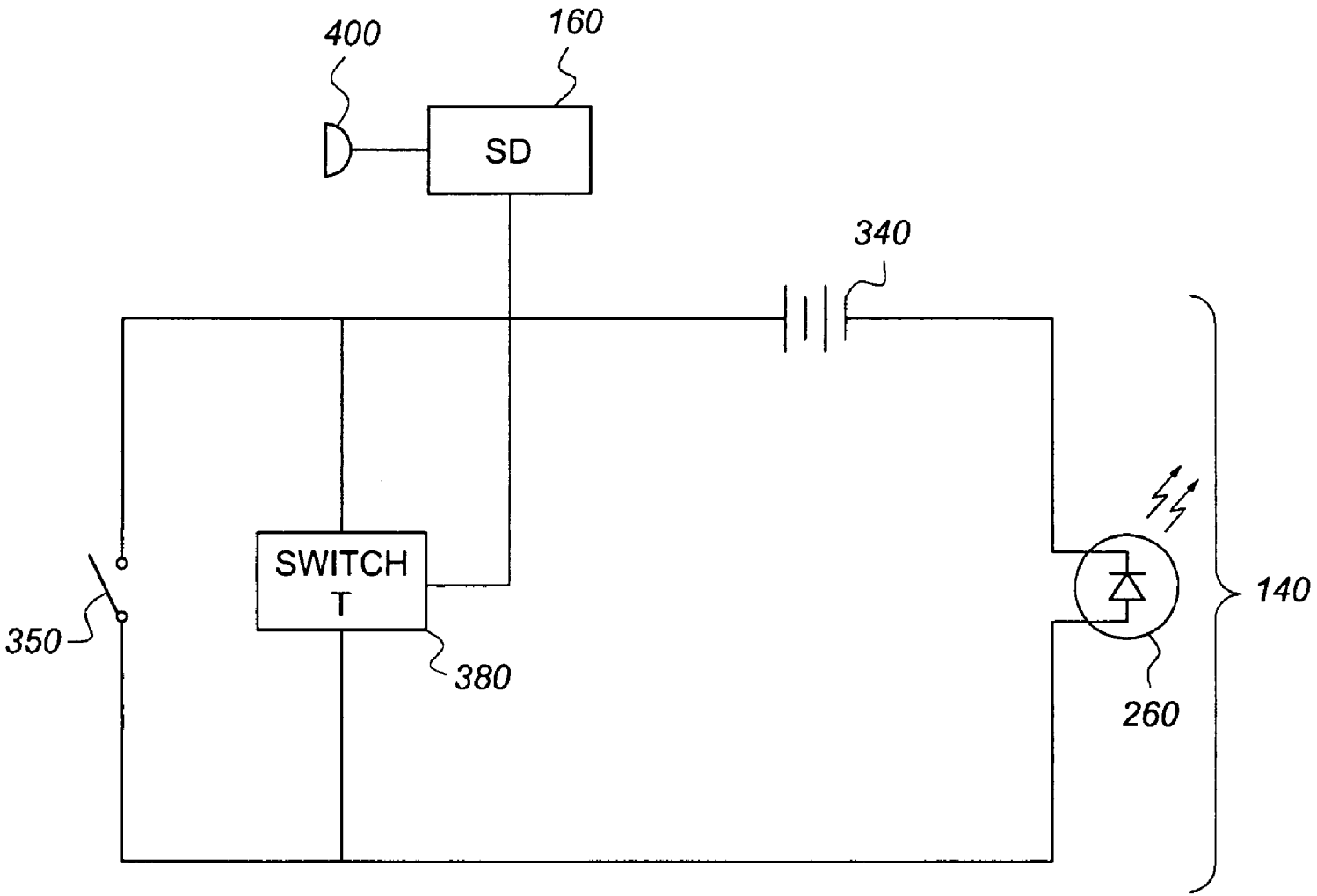
FIG. 5A is a circuit schematic of the illuminating device in which the sound discriminator is operably coupled to a lighting circuit according to the present invention.

FIG. 5A shows sound discriminator 160 operably coupled to a lighting circuit 140. Sound discriminator 160 processes output received from microphone 400. Lighting circuit 140 includes at least one light 260, power source 340, first switch 380 and a manually operated switch 350. Power source 340 is made up of at least one battery such as a pair of AA or AAA batteries. Switch 380 can include a timer T to ensure that switch 380 closes for a desired time period thereby powering light source 260 for the desired time period First switch 380 is shown in parallel configuration with respect to the manually operated switch 350, which takes the form of a manually operated on/off switch. User U can close on/off switch 350 to cause light source 260 to operate independent of the status of first switch 380. First switch 380 is activated for a predetermined time by sound discriminator 160. The sound discriminator 160 activates first switch 380 based on input received from microphone 400. Upon activation, first switch 380 allows electrical current to flow to light source 260.

Figure 5B:
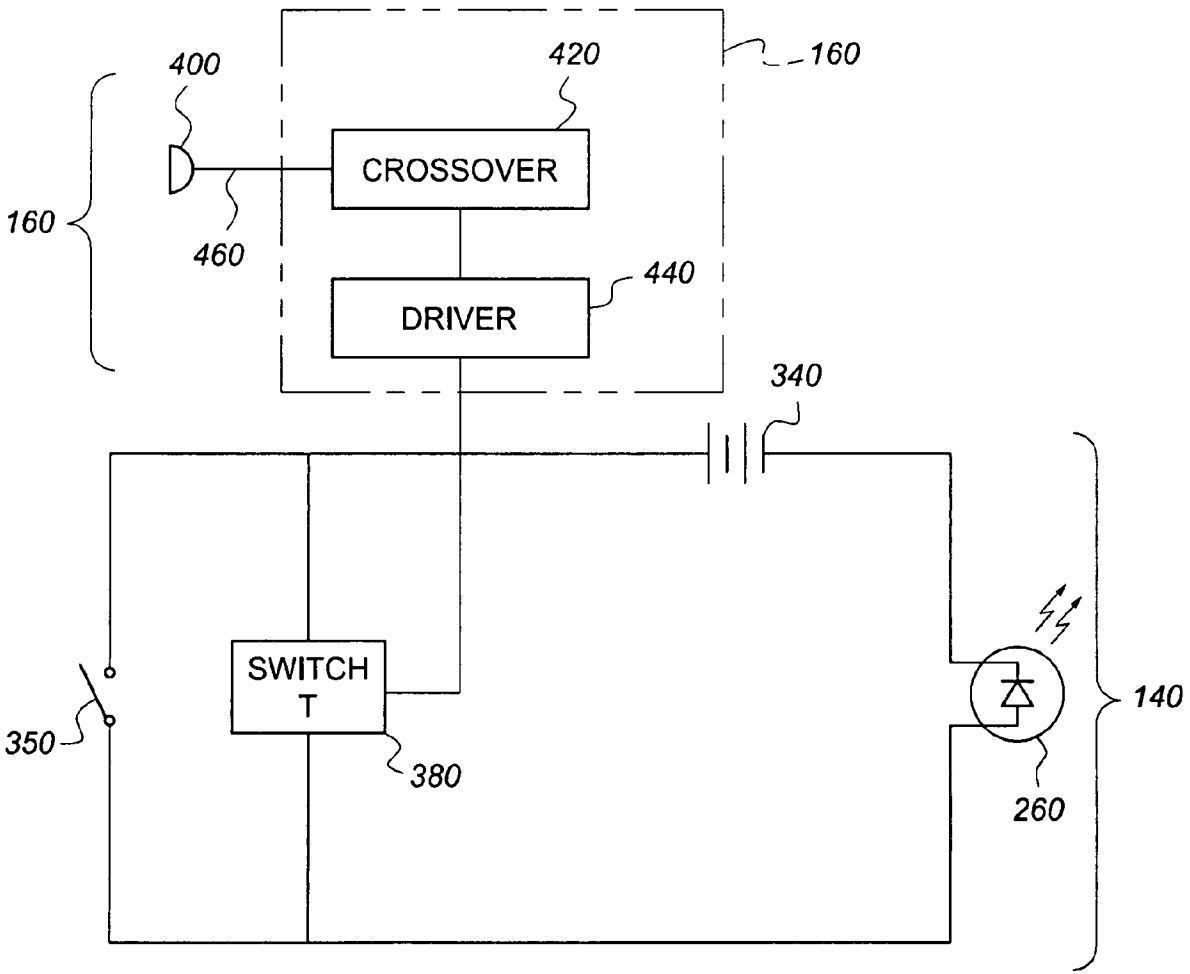
FIG. 5B shows a sound discriminator that includes a crossover circuit according to the present invention.

The preferred type of the sound discriminator 160 is a narrow band-pass filter; a narrow band-pass filter is described in U.S. Pat. No. 4,417,235 issued Nov. 22, 1983 to Del Grande ("the Grande '235 patent"); the Grande '235 patent is herein incorporated by reference in its entirety. Such sound discriminators can be attuned to the frequency, for example, of jangling keys 210. In FIG. 5B the sound discriminator 160 takes the form of at least one crossover circuit 420. The crossover 420 is shown coupled to an optional driver 440 for operating the switch 380; the driver 440 may or may not be considered part of the sound discriminator 160. The at least one crossover circuit 420 is an electrical device that only conducts electricity of a certain frequency range. Crossover circuits are well known; passive crossovers, for example, are constructed of one or more LC (inductor/capacitor), LCR (inductor/capacitor/resistor), RC (resistor/capacitor), and RL (resistor/inductor) circuits, alone or in combination. Crossover circuits are well known; for example, in the art of car security devices the crossover device is used to detect the frequency of breaking glass, wherein the crossover is configured to only conduct electrical current that has the frequency of breaking glass to trigger a car alarm; other sounds are ignored.

As noted above, the crossover circuit 420 can be configured, for example, to tune into the sound (i.e., frequency) of jangling keys 210 (see FIG. 1) and only allow electrical frequencies (output from the microphone 400) corresponding to the frequency of jangling keys 210 to pass through the crossover circuit 420. The crossover 420 can be an active crossover or a passive crossover. If the crossover 420 is passive, the frequency cutoffs are likely factory set according to the specification of the components used in the crossover 420. An active form of crossover 420 could be adjusted after manufacture to tune into noises generated inside a particular type of hand-held container, e.g. a handbag for carrying general items verses a large purse for carrying money and keys.

In addition, the crossover circuit 420 may comprise a simple LC circuit configured to screen out a high frequency sound, and more particularly, configured to screen out high frequency alternating electrical signals received from microphone 400. Alternatively, the crossover circuit 420 may comprise a simple LC circuit configured to screen out a low frequency sound, and more particularly, configured to screen out low frequency alternating electrical signals received from microphone 400.

Still referring to FIG. 5B, as mentioned above crossover 420 can be factory set to only conduct electricity that has the frequency of, for example, jangling car keys. The sound of jangling keys inside hand-held container 200 would be picked up by microphone 400 and converted to electricity along line 460 and conducted across crossover 420 to activate driver 440 to close switch 380 to allow current to flow in lighting circuit 140 and drive light source 260. Switch 380 remains closed for a predetermined time thereby allowing current to flow to the light source 260 for the predetermined time.

Figure 5C:
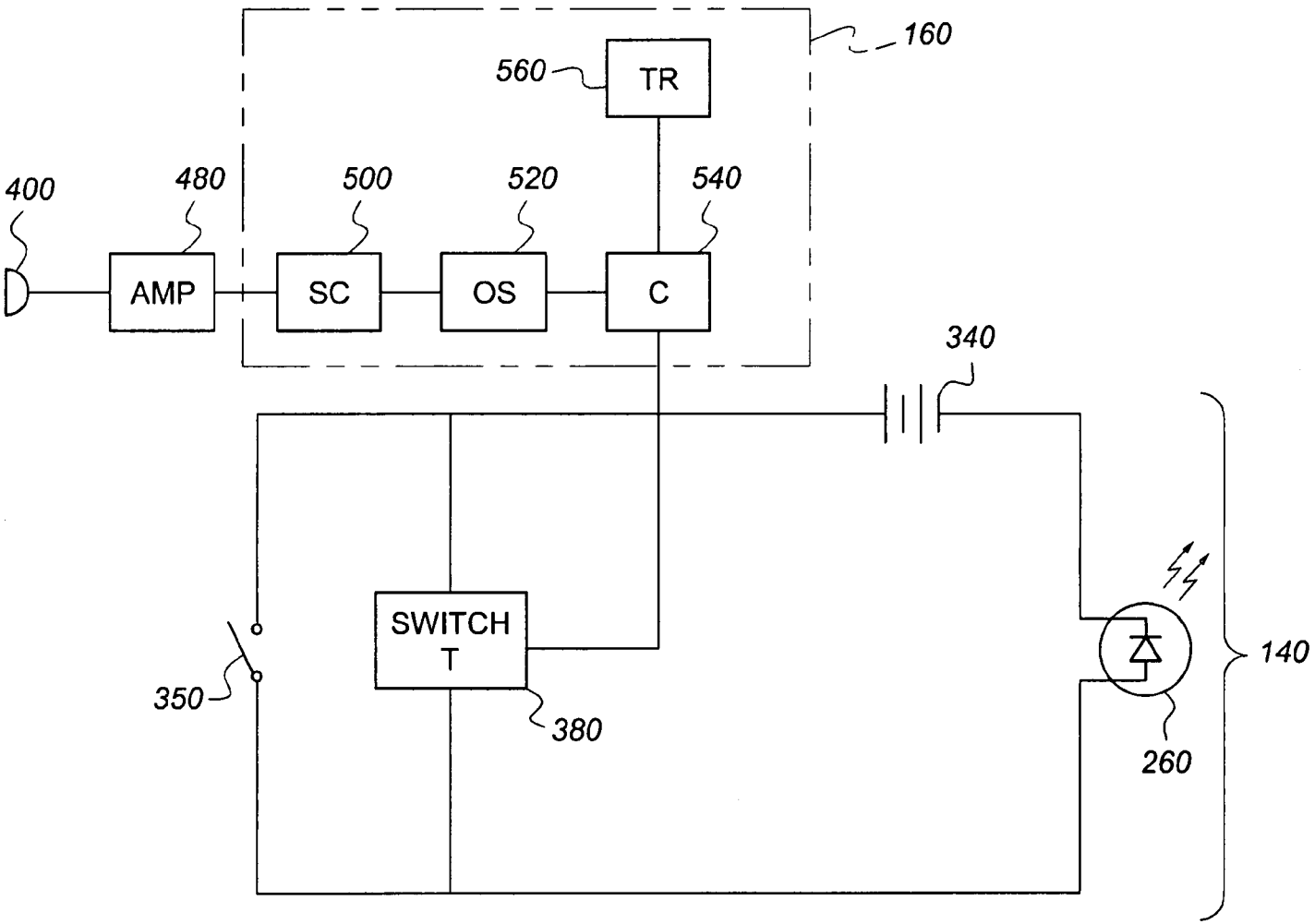
FIG. 5C shows a sound discriminator that incorporates a digital sampling circuit according to the present invention.

FIG. 5C shows another embodiment of the invention 100, which incorporates a sound discriminator 160 similar in design to a digital sampling circuit described in U.S. Pat. No. 4,633,234 ("the Gagnon '234 patent) issued Dec. 30, 1986 to Gagnon; the Gagnon '234 patent is herein incorporated by reference in its entirety. An optional conventional audio amplifier 480 amplifies output from microphone 400. The amplified audio signals are processed by a sensitivity control 500. Sensitivity control 500 determines the amplitude (i.e. level) of the sound waves, only those sound waves having amplitudes that exceed a prescribed value result in the delivery of corresponding electrical signals to the input of one-shot pulse generator 520. One-shot generator 520 outputs a digital pulse in response to the receipt of each audio signal received from the sensitivity control 500. The digital pulse output by one-shot 520 is delivered to the input of a counter 540. Counter 540 receives and accumulates counts corresponding to the number of digital pulses output by one-shot 520. Timer-reset 560 produces a reset pulse to reset counter 540 at predetermined time intervals. If counter 540 reaches a count equal or above a predetermined number of counts within a predetermined time interval a signal is sent to switch 380 to close. As stated above, switch 380 can include a timer T to ensure that switch 380 closes for a desired time period thereby powering light source 260 for the desired time period; alternatively, switch 380 can be operably coupled to the timer T. Thus switch 380 can be configured to switch off after the desired time period. The timer T may be adjustable by user U. It should be understood that the switch 380 shown in FIGS. 5A and 5B may also incorporate timer T or be operably coupled to timer T.

The audio amplifier 480 may be left out of the device 100 of FIG. 5C. In this form of the invention the device 100 would only trigger the switch 380 if the volume of the sound inside the hand-held container matches or exceeds a predetermined amplitude (i.e. level) and/or predetermined frequency. Thus, the sound discriminator 160 could discriminate based on volume and/or frequency of sounds inside the hand-held container 180. Alternatively, one or more transistors may be used to amplify the output of the microphone 400 to a predetermined value. The microphone 400 may incorporate one or more conventional amplifiers.

The microphone 400 can include, or be integrated with, a conventional amplifier. The microphone 400 may be of any suitable type such as a directional or non-directional microphone. It should also be understood that other components could be integrated or combined, for example, the crossover 420 could be integrated with driver 440.

In a further aspect of the invention, the device 100 is combined with a hand-held container. For example, device 100 may be sold with a handbag or purse.

It is to be understood that the present invention is not limited to the embodiments described above, but encompasses any and all embodiments within the scope of the following claims.

We claim:

1. An illuminating device for illuminating the interior of a hand-held container when a predetermined level or frequency of sound energy is detected inside the hand-held container, comprising:

a housing;

a lighting circuit; and a sound discriminator operably connected to said lighting circuit, wherein said sound discriminator is adapted to detect a predetermined level of sound energy or a predetermined frequency of sound energy inside the hand-held container, whereby when said sound discriminator detects the predetermined level or frequency of sound energy then said sound discriminator circuit activates said lighting circuit to illuminate the interior of the hand-held container.

2. The illuminating device according to claim 1, wherein said lighting circuit comprises at least one light emitting diode (LED).

3. The illuminating device according to claim 1, further comprising a manually operable switch, wherein said switch forms part of said lighting circuit and allows a user to operate said lighting circuit independent of said sound discriminator to illuminate the interior of the hand held container.

4. An illuminating device in combination with a hand-held container, wherein said illuminating device is used to illuminate the interior of said hand-held container, comprising:

a hand-held container;

a housing;

an electrical power source;

a lighting circuit, wherein said lighting circuit comprises a light source, and a first switch; and a sound discriminator for detecting a predetermined level or frequency of sound energy inside said hand-held container, wherein said sound discriminator is operably connected to said first switch, whereby when said sound discriminator detects the predetermined amount of sound energy said sound discriminator circuit activates said first switch to enable power to flow to said light source and illuminate the inside of said hand-held container.

5. The combination invention according to claim 4, wherein said first switch operates for a predetermined time to allow electrical power to flow through said lighting circuit to drive said light source.

6. The combination invention according to claim 4, wherein said light source comprises at least one light emitting diode.

7. The combination invention according to claim 4, wherein said power source comprises at least one battery.

8. The combination invention according to claim 4, wherein said lighting circuit further comprises a manually operable switch, wherein manually operable switch enables power to flow to said light source independent of said sound discriminator.

9. The combination invention according to claim 4, wherein said hand-held container is a handbag.

10. The combination invention according to claim 4, wherein said hand-held container is a purse.

11. An illuminating device for illuminating the interior of a hand-held container in response to sound in a hand-held container, comprising:

a microphone for converting sound waves into alternating electrical signals;

a means for detecting and generating a trigger signal in response to specific alterations in the alternating signals that correspond to sound energy generated inside a hand-held container; and a means for providing light energy upon receipt of the trigger signal.

12. The illuminating device according to claim 11, wherein said means for detecting and generating a trigger signal comprises a narrow band-pass filter tuned to detect sound from jangling keys.

13. The illuminating device according to claim 1, wherein said sound discriminator is a narrow band-pass filter tuned to detect sound from jangling keys.

14. The combination invention according to claim 4, wherein said sound discriminator is a narrow band-pass filter tuned to detect sound from jangling keys.

* * * * *